US010549146B2

(12) United States Patent
Ivy

(10) Patent No.: US 10,549,146 B2
(45) Date of Patent: Feb. 4, 2020

(54) JUMPBOARD AND BALLET BAR REFORMER ACCESSORY

(71) Applicant: Christine Ivy, Glendora, CA (US)

(72) Inventor: Christine Ivy, Glendora, CA (US)

(73) Assignee: Ivy House, LLC, Glendora, CA (US)

( * ) Notice: Subject to any disclaimer, the term of this patent is extended or adjusted under 35 U.S.C. 154(b) by 215 days.

(21) Appl. No.: 15/613,244

(22) Filed: Jun. 4, 2017

(65) Prior Publication Data

US 2018/0345067 A1 Dec. 6, 2018

(51) Int. Cl.
*A63B 22/00* (2006.01)
*A63B 21/00* (2006.01)
(Continued)

(52) U.S. Cl.
CPC ..... *A63B 22/0087* (2013.01); *A63B 1/00* (2013.01); *A63B 5/16* (2013.01); *A63B 21/023* (2013.01);
(Continued)

(58) Field of Classification Search
CPC .. A63B 1/00; A63B 1/005; A63B 5/00; A63B 5/08; A63B 5/10; A63B 5/11; A63B 5/16; A63B 2005/085; A63B 6/00; A63B 21/00058; A63B 21/00061; A63B 21/00065; A63B 21/00069; A63B 21/00072; A63B 21/00076; A63B 21/00178; A63B 21/00181; A63B 21/00185; A63B 21/002; A63B 21/0023; A63B 21/02; A63B 21/023; A63B 21/025; A63B 21/026; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/16; A63B 21/1672; A63B 21/4027; A63B 21/4029; A63B 21/4033; A63B 21/4034; A63B 21/4035; A63B 21/4041; A63B 21/4045; A63B 21/4047; A63B 21/4049; A63B 22/0015;
(Continued)

(56) References Cited

U.S. PATENT DOCUMENTS 4,696,470 A * 9/1987 Fenner ..... A63B 1/00 182/153
6,743,152 B2 * 6/2004 Weiss ..... A63B 1/00 482/34
(Continued)

OTHER PUBLICATIONS http://www.wundabar.com/wundaformer/, downloaded on Jun. 4, 2017.

*Primary Examiner* — Gary D Urbiel Goldner
(74) *Attorney, Agent, or Firm* — Lynch LLP

(57) ABSTRACT

A Pilates reformer accessory that couples with a Pilates reformer. The accessory includes a jumpboard, and in some embodiments, it also includes a ballet bar attachment. Jumpboards of the inventive subject matter have several regions on a surface that help a user practice jumps while using the Pilates reformer. The ballet bar attachment can be coupled with the jumpboard, and the ballet bar attachment can include a latching hinge that enables the ballet bar attachment to be easily repositioned relative to the jumpboard.

20 Claims, 8 Drawing Sheets

(51) Int. Cl.

| | |
|---|---|
| ***A63B 21/02*** | (2006.01) |
| ***A63B 21/055*** | (2006.01) |
| ***A63B 23/02*** | (2006.01) |
| ***A63B 23/04*** | (2006.01) |
| ***A63B 5/16*** | (2006.01) |
| ***A63B 1/00*** | (2006.01) |
| ***A63B 71/06*** | (2006.01) |

(52) U.S. Cl.
CPC ..... *A63B 21/0552* (2013.01); *A63B 21/4035* (2015.10); *A63B 22/0046* (2013.01); *A63B 23/0233* (2013.01); *A63B 23/04* (2013.01); *A63B 71/0622* (2013.01); *A63B 2071/0602* (2013.01); *A63B 2225/09* (2013.01)

(58) Field of Classification Search
CPC ..... A63B 22/0017; A63B 22/0046; A63B 22/0076; A63B 22/0087; A63B 22/0089; A63B 23/0205; A63B 23/0211; A63B 23/0216; A63B 23/0222; A63B 23/0233; A63B 23/035; A63B 23/03508; A63B 23/03516; A63B 23/03525; A63B 23/0355; A63B 23/03558; A63B 23/03566; A63B 23/03575; A63B 23/04; A63B 23/0405; A63B 23/0482; A63B 23/0494; A63B 23/12; A63B 23/1209; A63B 23/1218; A63B 23/1227; A63B 23/1236; A63B 23/1245; A63B 23/1281; A63B 2023/006; A63B 2023/0411; A63B 69/06; A63B 2069/062; A63B 2069/064; A63B 2069/066; A63B 71/0054; A63B 71/0619; A63B 71/0622; A63B 71/0669; A63B 71/0672; A63B 2071/0063; A63B 2071/00725; A63B 2071/0081; A63B 2071/009; A63B 2071/0602; A63B 2071/0636; A63B 2071/0638; A63B 2071/0647; A63B 2071/065; A63B 2071/0655; A63B 2071/0694; A63B 2208/0214; A63B 2208/0219; A63B 2208/0223; A63B 2208/0228; A63B 2208/0233; A63B 2208/0238; A63B 2208/0242; A63B 2208/0247; A63B 2208/0252; A63B 2208/0257; A63B 2208/0266; A63B 2208/0295; A63B 2210/00; A63B 2210/50; A63B 2225/09; A63B 2225/093; A63B 2225/10; A63B 2225/102; A63B 2225/105; A63B 2225/107; A63B 2244/22

See application file for complete search history.

(56) References Cited

U.S. PATENT DOCUMENTS

| | | | | |
|---|---|---|---|---|
| 8,602,953 | B2 | 12/2013 | Jordan | |
| D726,263 | S * | 4/2015 | Anderson | A63B 1/00 D21/676 |
| 9,295,866 | B2 * | 3/2016 | Kwo | A63B 1/00 |
| 9,474,922 | B2 | 10/2016 | Magrella | |
| 10,010,735 | B2 * | 7/2018 | Kwo | A63B 1/00 |
| 10,046,193 | B1 * | 8/2018 | Aronson | A63B 21/025 |
| 10,118,067 | B2 * | 11/2018 | Lagree | A63B 23/03516 |
| 2006/0035750 | A1 * | 2/2006 | Weiss | A63B 1/00 482/34 |
| 2009/0098987 | A1 * | 4/2009 | McBride | A63B 21/023 482/133 |
| 2012/0202661 | A1 * | 8/2012 | Jordan | A63B 21/055 482/142 |
| 2013/0210593 | A1 * | 8/2013 | McBride | A63B 1/00 482/142 |
| 2013/0331232 | A1 * | 12/2013 | Kwo | A63B 1/00 482/38 |
| 2014/0141948 | A1 * | 5/2014 | Aronson | A63B 21/023 482/128 |

* cited by examiner

FIG. 4
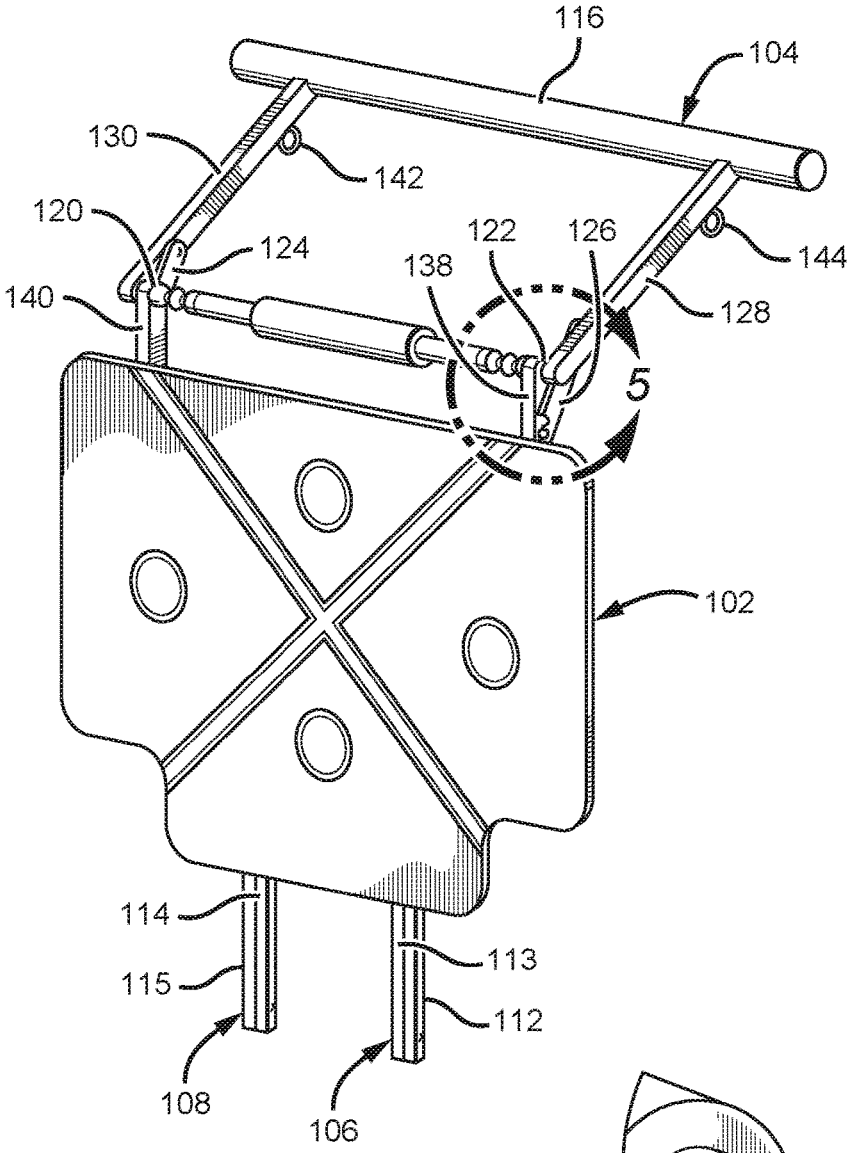
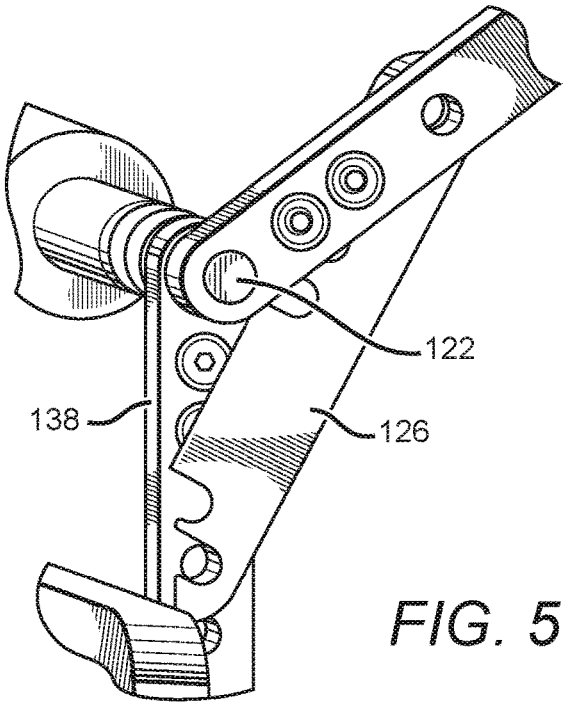
FIG. 5

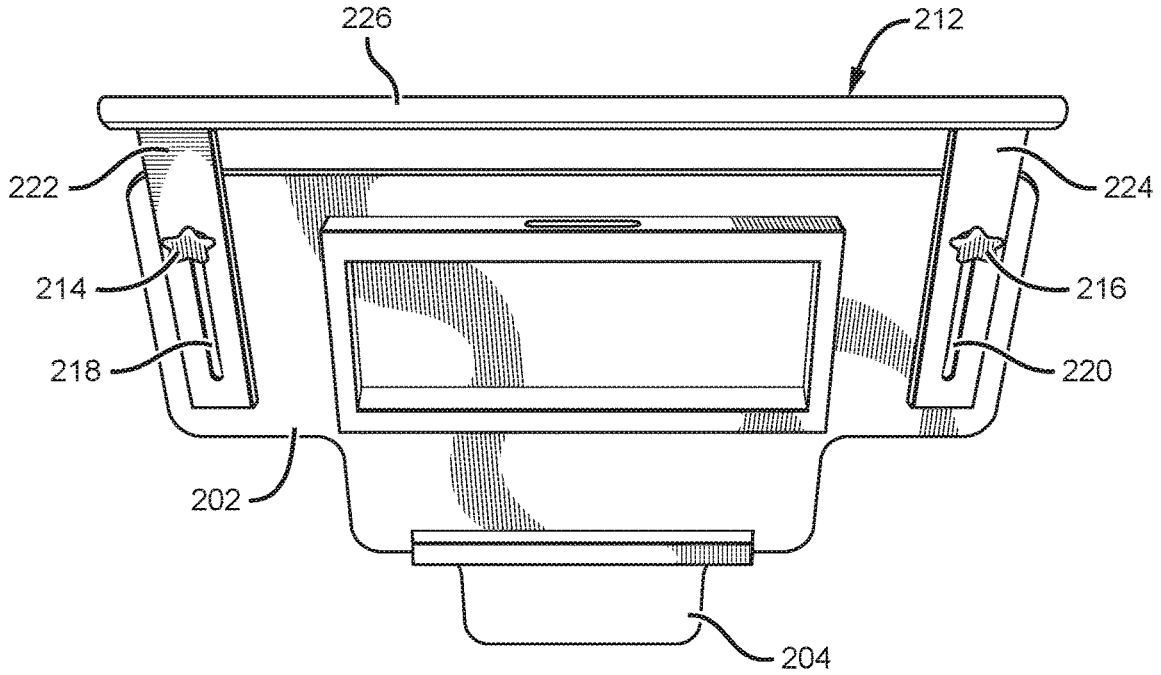
FIG. 6
FIG. 7
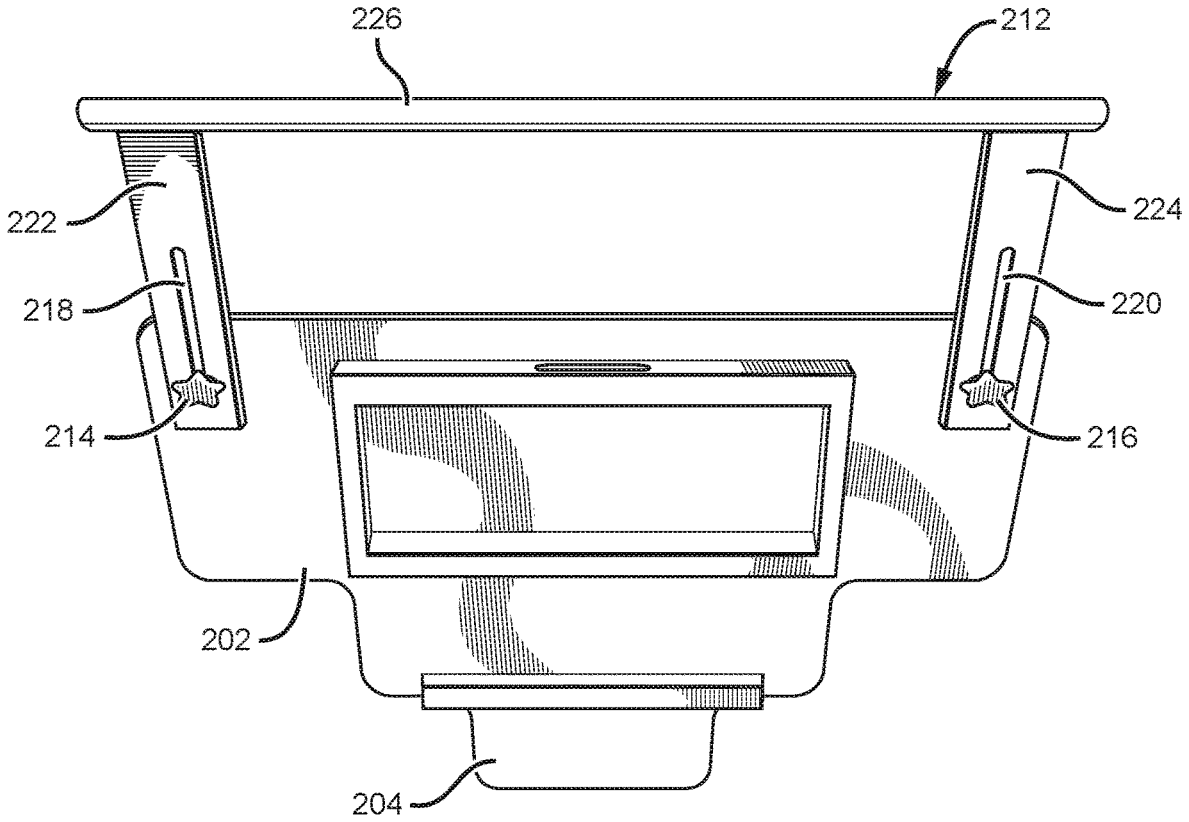

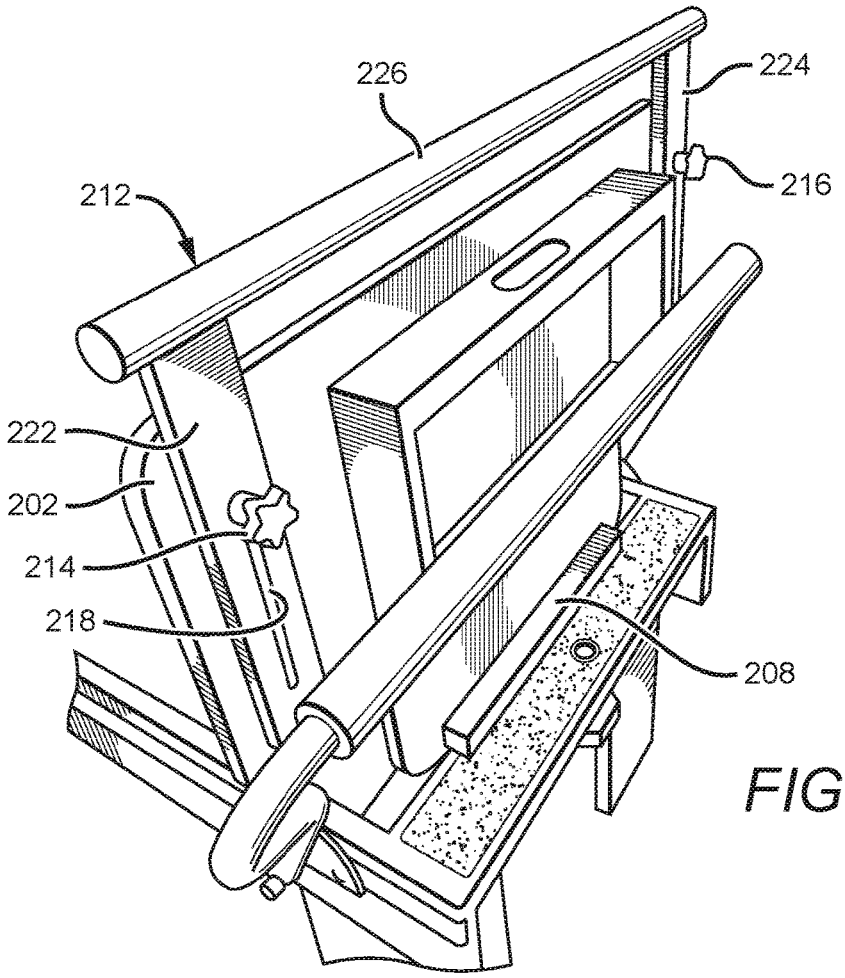
FIG. 10
FIG. 11
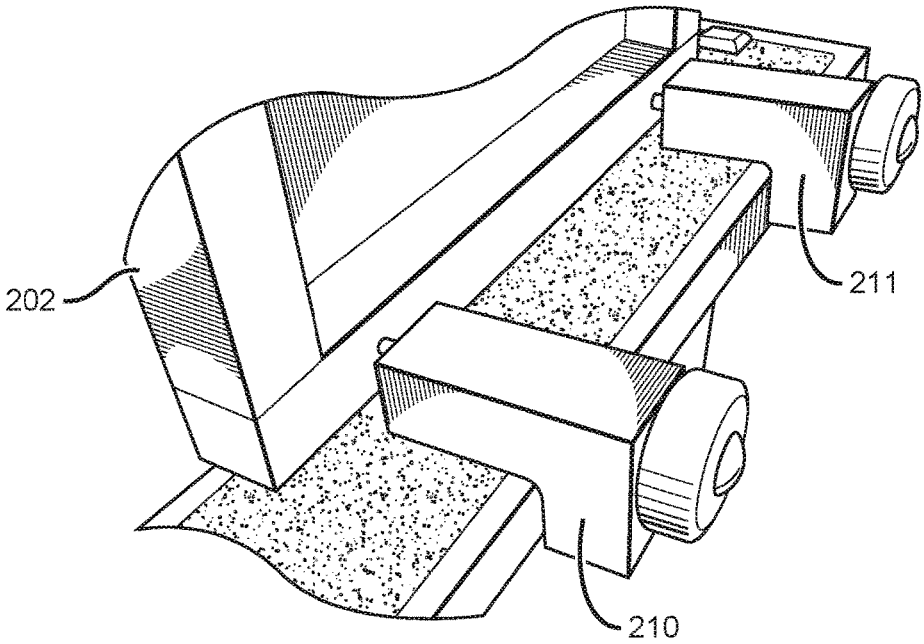

JUMPBOARD AND BALLET BAR REFORMER ACCESSORY

FIELD OF THE INVENTION

The field of the invention is Pilates reformer accessories.

BACKGROUND

The background description includes information that may be useful in understanding the present invention. It is not an admission that any of the information provided in this application is prior art or relevant to the presently claimed invention, or that any publication specifically or implicitly referenced is prior art.

Although many efforts have been made to develop accessories that couple with Pilates reformers, past efforts have failed to consider the usefulness associated with combining various existing accessories that otherwise appear to be unrelated.

U.S. Pat. No. 8,602,953 describes a Pilates reformer that can include many different components including a both a jumpboard and a reformer. But the '953 patent fails to appreciate other ways accessories that incorporate a jumpboard and a ballet bar can be brought to fruition. The '953 patent fails to describe, for example, a jumpboard having regions on its surface that help improve a user's skills with the jumpboard.

U.S. Pat. No. 9,474,922 describes a combination exercise machine that enables users to do both Pilates and barre workouts. But this patent fails to consider advantages gained by creating an accessory for a Pilates reformer, and it also fails to even consider inclusion of a jumpboard.

In addition, there exists a product called the Wunda-Former that includes a jumpboard with an incorporated ballet bar. But that product fails to appreciate additional features that improve usability, versatility, and ease of use.

These and all other extrinsic materials discussed in this application are incorporated by reference in their entirety. Where a definition or use of a term in an incorporated reference is inconsistent or contrary to the definition of that term provided in this application, the definition of that term provided in this application applies and the definition of that term in the reference does not apply.

It has yet to be appreciated that an improved jumpboard and an improved jumpboard and ballet bar can be created to fit a gap in current technology.

SUMMARY OF THE INVENTION

In one aspect of the inventive subject matter, an accessory for use with an exercise device (e.g., a Pilates reformer) is contemplated. The accessory includes a jumpboard, a ballet bar adjustably coupled to the jumpboard, and a coupling feature to facilitate coupling the accessory with the exercise device (e.g., a tab that is sized and dimensioned to fit into a slot on the exercise device, or one or more frames that can fit into a slot on the exercise device).

In some embodiments, the jumpboard has a surface that is into at least two regions, where each region is identifiably different from each other. The regions can differ by, for example, a material or a visual identifiable characteristic (e.g., a pattern, a color, a non-repeating visual feature, or some combination thereof). The regions can also be differentiated by tactilely identifiable characteristics (e.g., texture).

It is contemplated that the ballet bar's position relative to the jumpboard is adjustable. The accessory can also include a handle (e.g., coupled with the jumpboard) to improve portability and usability.

In another aspect of the inventive subject matter, another accessory for use with an exercise device is contemplated. This accessory includes a jumpboard having a surface that is divided into two regions where the regions are distinguishable by having different characteristics. The characteristics of the regions can differ by, for example, visually identifiable characteristics (e.g., a pattern, a color, and a non-repeating visual feature, or any combination thereof), tactilely identifiable characteristics, materials (e.g., the regions can be characterized by different materials like fabric, plastic, wood, rubber, or any combination thereof).

In some embodiments, the accessory includes a coupling feature to attach the accessory to the exercise device. The coupling feature in some embodiments includes a tab that is sized and dimensioned to couple with the exercise device. In other embodiments, the coupling feature includes two frames that are sized and dimensioned to couple with the exercise device. It is additionally contemplated that these coupling features are not mutually exclusive and some combination of the two could also be implemented.

Some embodiments of the accessory additionally include an expansion feature to facilitate use of the accessory with an expansion product (e.g., a resistant band, a spring, and a cantilevered beam). It is contemplated that the accessory can include a handle affixed to the jumpboard to facilitate transportation and use of the accessory.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 4 shows a front view of the accessory of FIG. 1.

FIG. 5 shows a detail view of a latching hinge used to hold a ballet bar in a position.

FIG. 6 shows another embodiment of an accessory of the inventive subject matter.

FIG. 7 shows the accessory of FIG. 6 with the ballet bar extended vertically.

FIG. 10 shows another view of the accessory of FIG. 6 when coupled with a Pilates reformer.

FIG. 11 shows a detail view of a component of the accessory of FIG. 6 that is used to facilitate coupling the accessory with a Pilates reformer.

DETAILED DESCRIPTION

Figure 1:
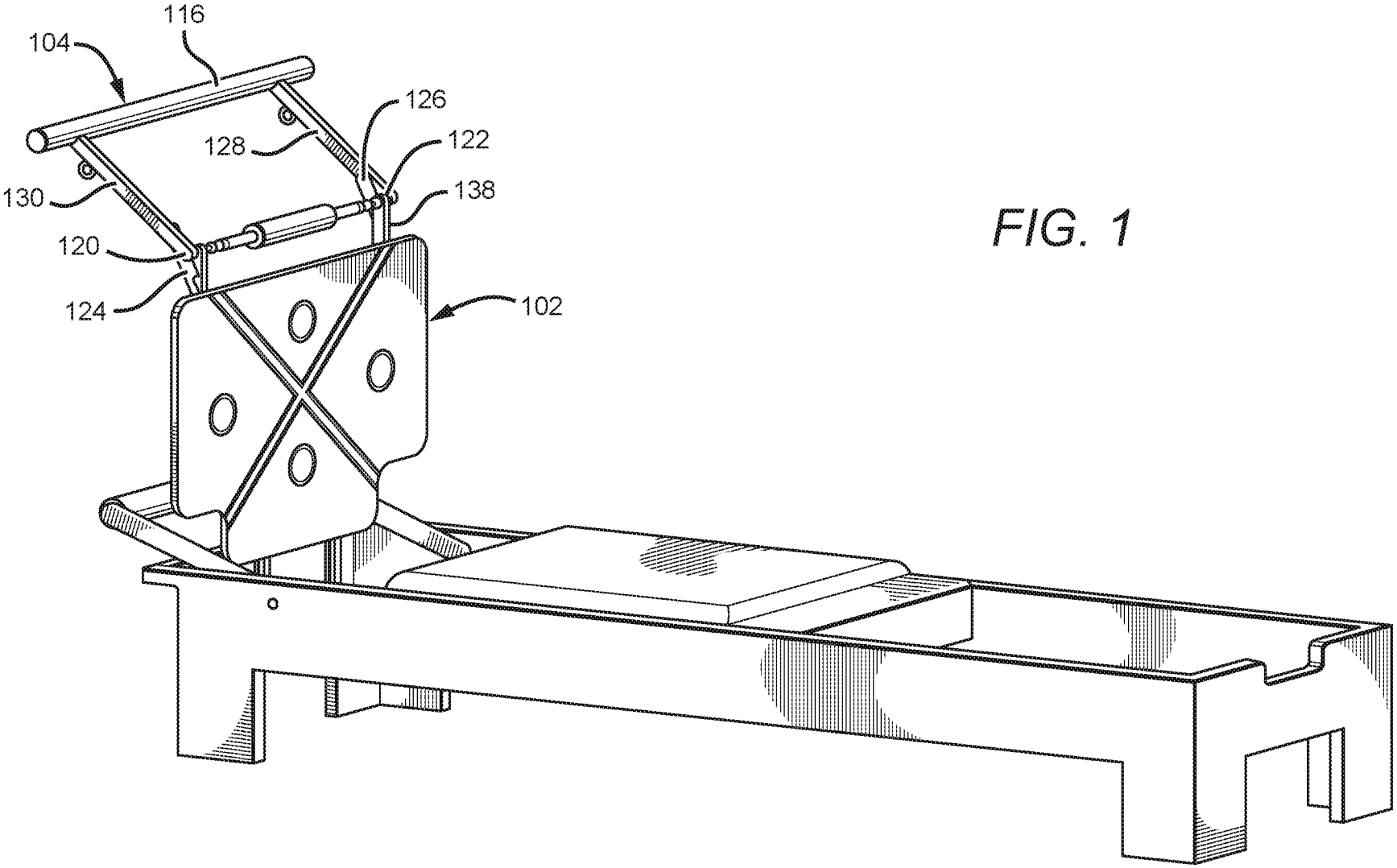
FIG. 1 shows an embodiment of an accessory of the inventive subject matter coupled with a Pilates reformer.

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The application describes inventive subject matter that is directed to accessories for exercise equipment, primarily Pilates reformers. In one aspect of the inventive subject matter, a jumpboard accessory is contemplated, and in another aspect, a jumpboard with an integrated ballet bar is contemplated. The inventive subject matter addresses a need among Pilates studios for reformer accessories that can be used to improve ballet-style jumps and that facilitate the incorporation of barre and barre-like fitness routines.

It is contemplated that embodiments of the inventive subject matter can come in several forms, including: a standalone jumpboard, a jumpboard with an attached ballet bar, and a ballet bar that can be retrofit onto an existing jumpboard (e.g., a jumpboard made according to the inventive subject matter in this application or any other kind of jumpboard).

Jumpboards of the inventive subject matter give users an improved ability to practice jumping while using a Pilates reformer. Jumps are an important part of ballet, and foot placement is critical to proper execution of a ballet jump. Specifically, proprioception is important for all populations, and by giving people visual and tactile aids, all types of people (e.g., athletic, general, aging, etc.) have the opportunity to sharpen visual and proprioceptive acuity, which is vital to keeping the mind, body, and neuromuscular connections sharp. It is therefore contemplated that the inventive subject matter can be used for preventative and rehabilitative purposes.

By giving users a jumpboard that includes well-defined regions that can be used to assist with foot placement (e.g., where the feet begin a jump and where the feet are supposed to land after a jump), users are able to more quickly master various skills.

Jumpboards of the inventive subject matter are seen in FIGS. 12*a*-12*d*. It is contemplated that jumpboards of the inventive subject matter include several regions on a surface that a user's feet contact during use. Each jumpboard depicted in FIGS. 12*a*-12*d* shows a different potential configuration for a region division on the surface.

Figure 12A:
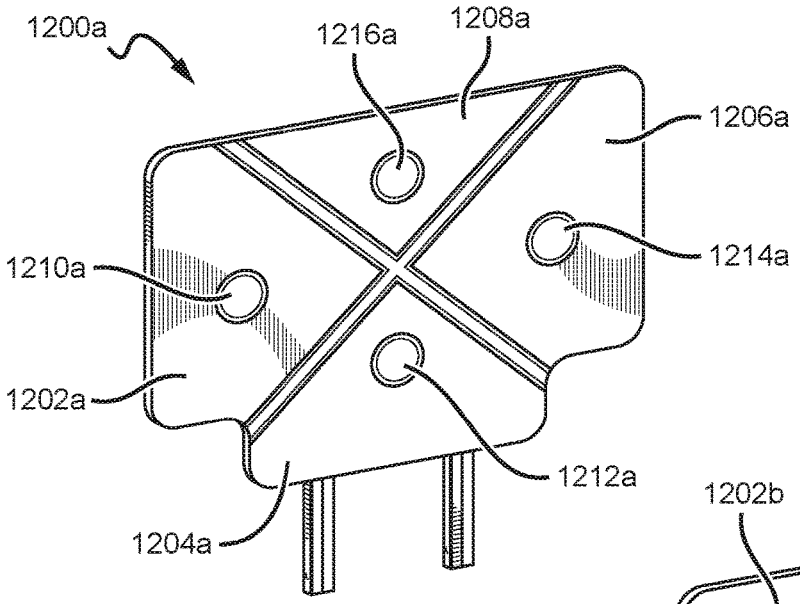
FIG. 12*a* shows a jumpboard of the inventive subject matter.
Figure 12B:
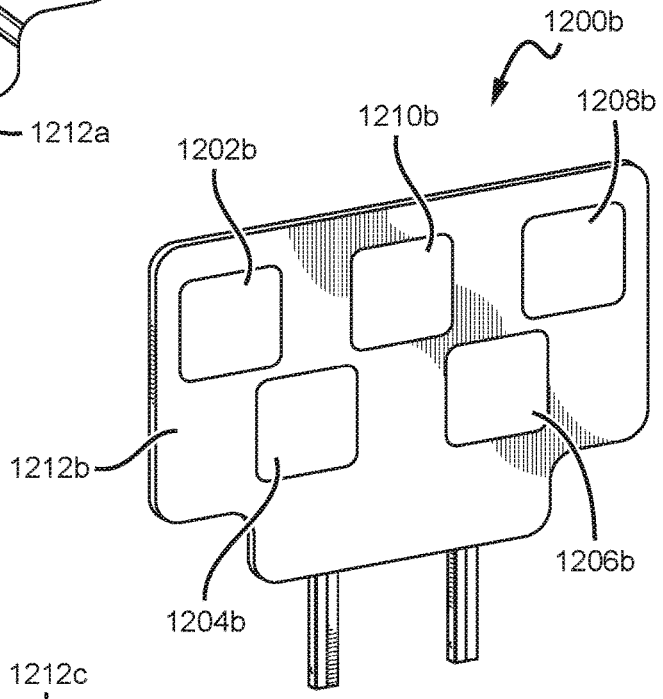
FIG. 12*b* shows another jumpboard of the inventive subject matter.
Figure 12C:
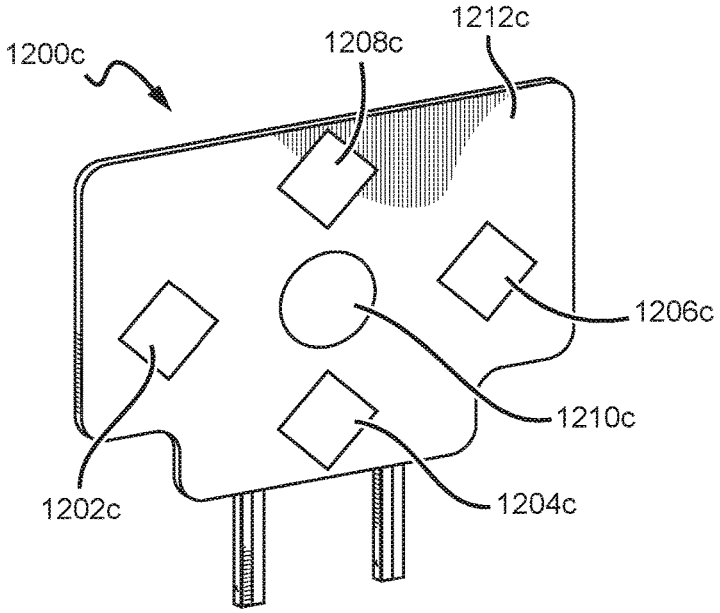
FIG. 12*c* shows another jumpboard of the inventive subject matter.
Figure 12D:
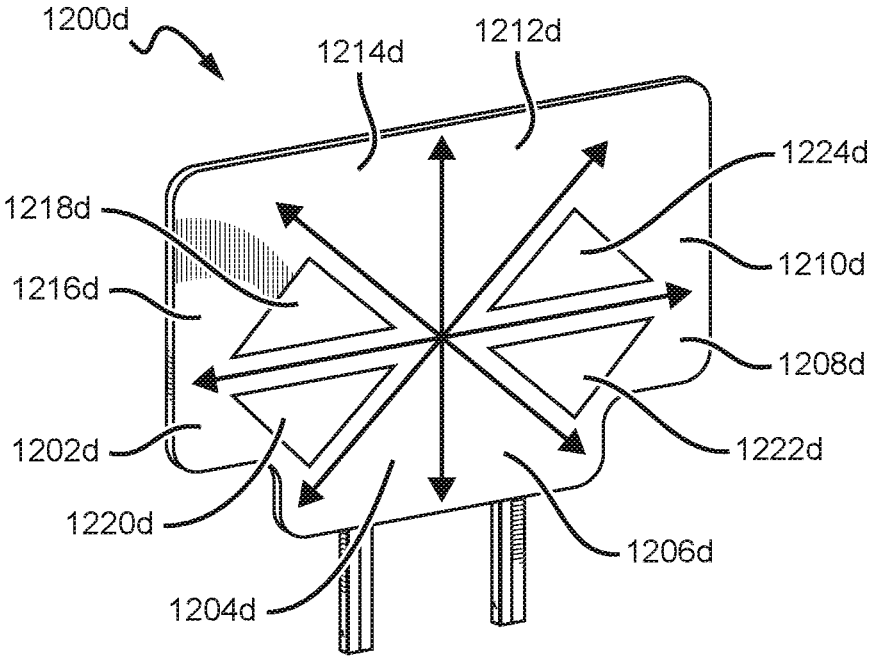
FIG. 12*d* shows another jumpboard of the inventive subject matter.

It is contemplated that there must be at least two regions, but the total number of regions can be greater depending on what is needed (e.g., 3, 4, 5, 6, 7, 8, 9, 10, 11, 12, 13-15, 15-20 regions and more, which includes regions and sub-regions, are also contemplated). For example, FIG. 12*a* shows a jumpboard 1200*a* with eight regions. The jumpboard in FIG. 12*a* includes four main regions 1202*a*, 1204*a*, 1206*a*, & 1208*a* with four sub-regions 1210*a*, 1212*a*, 1214*a*, & 1216*a*. The jumpboard in FIG. 12*b* includes five main regions 1202*b*, 1204*b*, 1206*b*, 1208*b*, & 1210*b* with interstitial space 1212*b* that can also be considered a region. The jumpboard 1200*c* in FIG. 12*c* includes five main regions 1202*c*, 1204*c*, 1206*c*, 1208*c*, & 1210*c* with interstitial space 1212*d* that can also be considered a region. The jumpboard 1200*d* in FIG. 12*d* includes eight main regions 1202*d*, 1204*d*, 1206*d*, 1208*d*, 1210*d*, 1212*d*, 1214*d*, & 1216*d* with four sub-regions 1218*d*, 1220*d*, 1222*d*, & 1224*d*.

Various configurations of the regions of a jumpboard are useful for different exercise regimens. Each region can be identified by an identifying characteristic, for example, material, visually identifiable characteristic (color, pattern, image, etc.), tactilely identifiable characteristic, or any combination thereof.

For example, when a jumpboard of the inventive subject matter is in use by a blind person (or someone that is otherwise visually impaired), that person could still practice their jumps with the aid of regions on the jumpboard that are identifiable by feel (i.e., tactilely identifiable). Thus, even if someone unable to visually distinguish between regions, they can still distinguish the regions by feel.

For embodiments of the jumpboard to have regions that are tactilely identifiable, the regions can be made from different materials. For example, regions or groups of regions could include wood, plastic, rubber, fabric, a synthetic material (e.g., neoprene), cushioning, or any combination thereof. Each region could be tactilely identifiable based on the material or combination of material that is used. In other embodiments, the same material or combination of materials could be used for each region, but each region could still nevertheless be made to have a different feel that is distinguishable, for example, by the feel of each region when underfoot. For example, regions can be made to have different hardnesses, different cushioning, different roughnesses, different smoothnesses, different patterns, regions can have ridge that run in different directions, etc. It is also contemplated that a region or group of regions could also have any combination of tactile qualities discussed above.

Different hardnesses can be achieved by using different materials, for example: metal for a hard surface, or a cushion (e.g., neoprene) for a soft surface. Different smoothnesses (e.g., different roughnesses or different surface material patterns or textures) can be achieved by, for example, molding rubber to have different surface qualities (e.g., ridges, bumps, divots, etc.).

In some embodiments, each region or group of regions can be visually identifiable to make the regions distinguishable. For example, regions or groups of regions can be different colors. It is also contemplated that regions or groups of regions can be identified by patterns, images, or other visual characteristics. A region or group of regions can incorporate any one or combination of the above-discussed distinguishing features.

Figure 2:
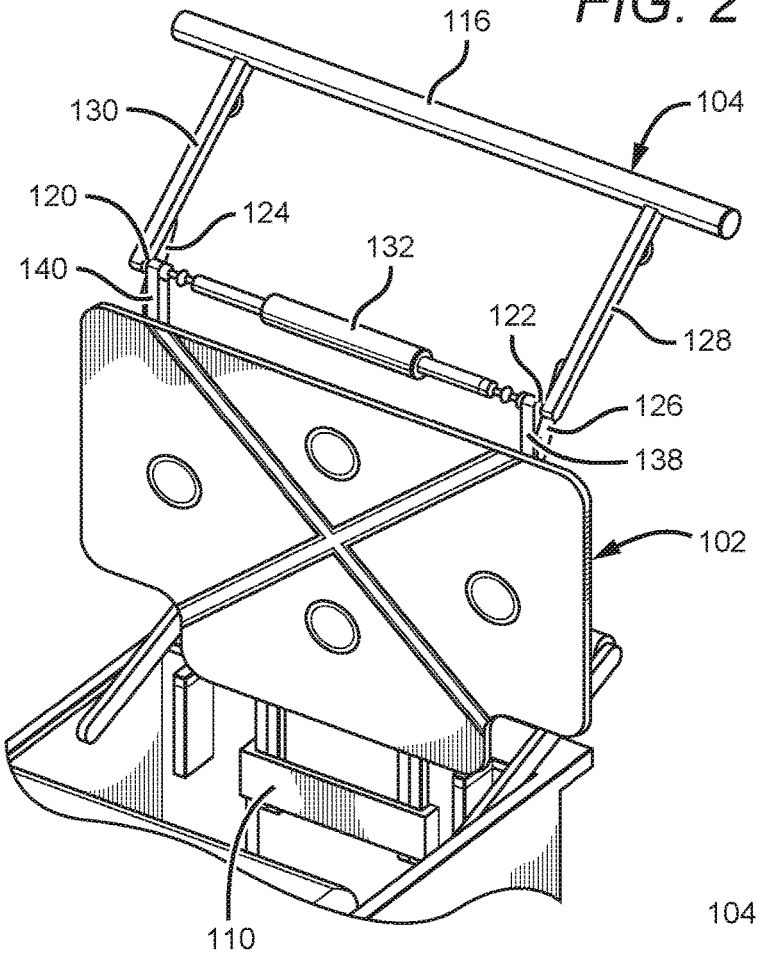
FIG. 2 shows another view of the accessory of FIG. 1.

Jumpboards of the inventive subject matter are designed to couple with Pilates reformers. FIGS. 1 and 2 show a jumpboard 102 coupled with a Pilates reformer. Although these figures additionally show an included ballet bar attachment 104, it is contemplated that the ballet bar attachment 104 can be excluded from the jumpboard 102.

Figure 3:
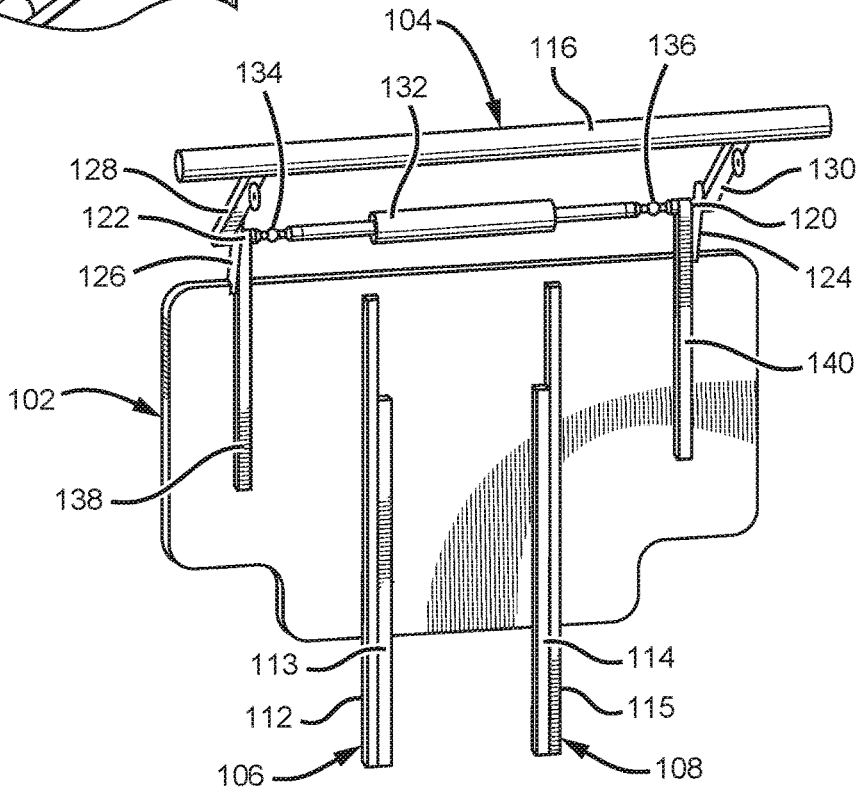
FIG. 3 shows a rear view of the accessory of FIG. 1.

Jumpboards of the inventive subject matter include a coupling feature to facilitate coupling with a Pilates reformer. As seen in FIGS. 1-4, the coupling feature can include a set of frames 106 & 108 that are coupled with the jumpboard 102. FIG. 3 shows that each frame 106 & 108 can include two rods 112 & 113 and 114 & 115, though it is contemplated that each frame can include only a single rod. One rod from each frame 106 & 108 can extend away from the jumpboard 102 to improve compatibility with a variety of Pilates reformers. Using frames is advantageous because they reduce overall weight while still providing necessary structural rigidity. Frames 106 &108 can be made from metal, plastic, or a composite material. The material selected for the frames 106 & 108 is not critical as long as the frames 106 & 108 are sufficiently rigid to prevent unnecessary movement or rotation of the jumpboard 102 during use (e.g., when the jumpboard is attached to a Pilates reformer and being used).

In some embodiments, frames 106 & 108 can be repositioned to change the distance between the two components. This can be accomplished by unfastening the frames from the jumpboard and refastening the frames to the jumpboard in different positions. The different positions can be predefined by, for example, pre-drilled holes, or pre-places nuts that bolts can fasten into after passing through the frames 106 & 108.

Figure 8:
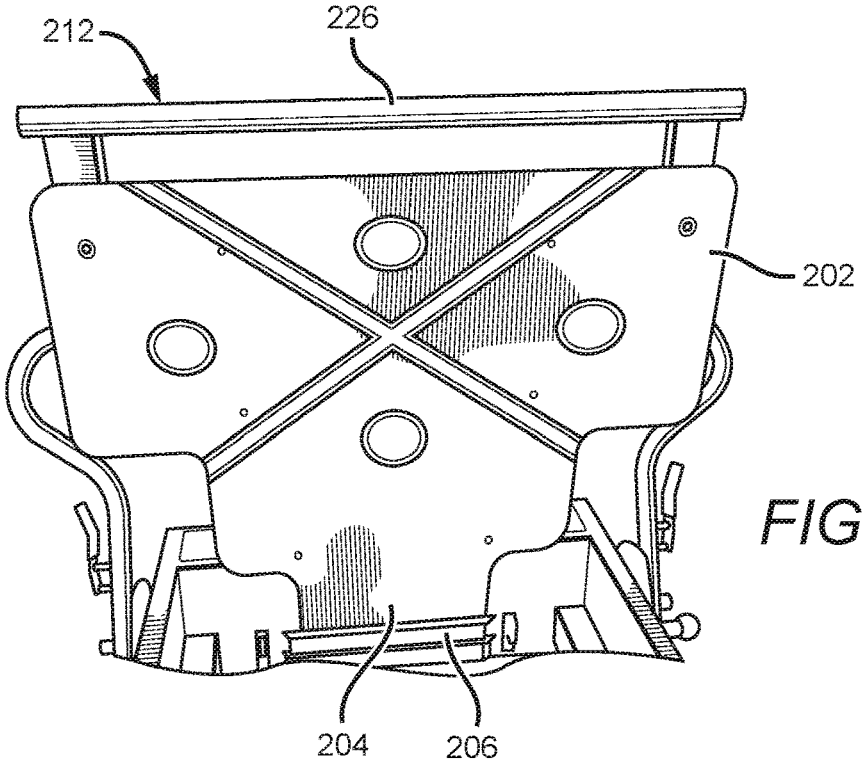
FIG. 8 shows the accessory of FIG. 6 when coupled with a Pilates reformer.
Figure 9:
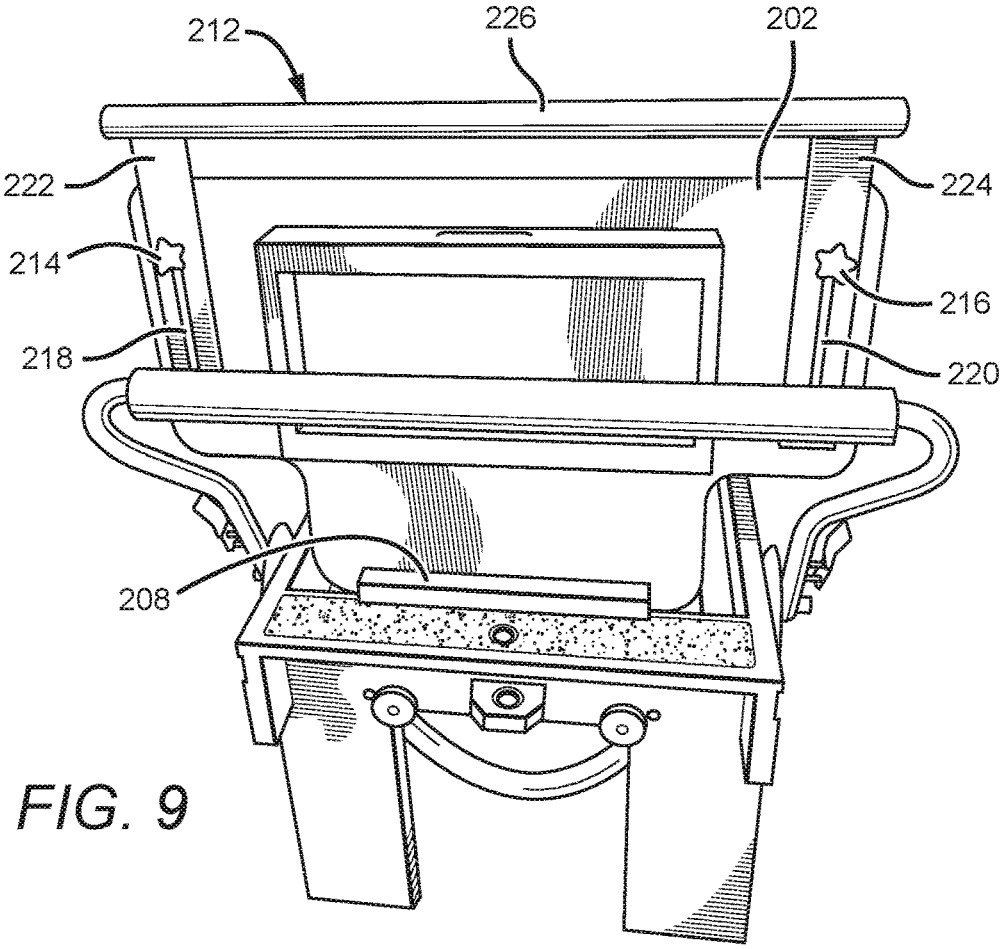
FIG. 9 shows a rear view of the accessory of FIG. 6 when coupled with a Pilates reformer.

In some embodiments, the jumpboard is formed to include a tab-like feature 204, like the jumpboard 202 shown in FIGS. 6-11. The tab-like feature 204 can either couple with a receiving slot that comes standard on a Pilates reformer, or it can fit into a slot that is formed by attachment of a bracket to a Pilates reformer that creates a receiving slot. The reformer depicted in FIGS. 6-11 includes a bracket 206 (e.g., a component that comes with the reformer, or a component that is affixed to the reformer by a third party), which is seen in FIG. 8.

Although depicted as a single tab in FIGS. 6-11, it is contemplated that the tab can comprise several tabs, similar to the frames shown in FIGS. 1-5. The overarching purpose of the tab and frames is to create a coupling that will allow the jumpboard to couple with a Pilates reformer in a stable and durable way.

Although some Pilates reformers include standard couplings to attach accessories, it is contemplated (as mentioned above) that an additional bracket can be included with a jumpboard to improve stability during use. While some Pilates reformers come with accessory couplings, in some cases, those couplings are not strong enough to withstand the needs of a jumpboard. Because stability and durability are needed, a standard coupling can be replaced or supplemented by, for example, a bracket. FIG. 2, for example, shows a bracket 110 that is used to stabilize the jumpboard 102 that is coupled with a Pilates reformer. Using bracket 110 increases resistance to damage from pushing and pulling on the jumpboard 102. Resistance to damage from forces in either direction is also useful when the jumpboard additionally includes a ballet bar (discussed in more detail below), where users could be either pushing or pulling on the ballet bar. A bracket can be fastened to a Pilates reformer using a variety of known fasteners (e.g., screws, nuts & bolts, adhesive, etc.).

Jumpboards of the inventive subject matter can additionally include a depth limiter that works in coordination with the coupling feature. For example, in the embodiment shown in FIGS. 6-11 where the coupling feature is a tab-like feature 204, the jumpboard 202 additionally includes a depth limiter 208. The purpose of the depth limiter 208 is to ensure the jumpboard 202 is optimally positioned relative to the Pilates reformer to which it is coupled.

In addition to a bracket, which is typically mounted carriage-side on a Pilates reformer (e.g., on the side facing a user), embodiments of the jumpboard can include additional components to increase stability of the jumpboard during use. For example, FIG. 11 shows additional stability components 210 and 211 that couple with the jumpboard to increase resistance to unwanted deflection of the jumpboard 202 during use. The components extend away from the jumpboard and rest against a surface of a Pilates reformer to increase stability. It is contemplated that stability components 210 and 211 can be included in any embodiment of the jumpboard.

In some embodiments, jumpboards of the inventive subject matter additionally include a ballet bar. People that practice Pilates often take part in other activities such as yoga or barre classes. Inclusion of a ballet bar facilitates the practice of both Pilates and barre.

Both FIGS. 1-5 and 6-11 depict jumpboards having ballet bar attachments. Looking at FIGS. 1-5 as an example, a ballet bar attachment 104 is coupled with the jumpboard as seen in FIG. 3 using two rods 112 & 114. The rods 112 & 114 can be coupled with the jumpboard 102 in several ways. For example, the rods 112 & 114 can be fastened to the jumpboard 102 using screw, nuts and bolts, an adhesive, or some combination of those. In other embodiments, the rods 112 & 114 can slide into slots cut into the back of the jumpboard 102.

Once coupled with a jumpboard, it is contemplated that a ballet bar attachment can be adjusted in a variety of ways. For example, in FIGS. 6-11, the height of the ballet bar attachment 212 can be changed using adjustment features 214 & 216. As seen in FIGS. 6 and 7, adjustment features 214 & 216 can be implemented into slots 218 & 220 in rods 222 & 224 that the ballet bar 226 couples with. By including slots 218 & 220, it is contemplated that adjustment features 214 & 216 can be implemented in a variety of ways. In the embodiment in FIG. 6-11, adjustment features 214 & 216 have threaded screw portions that screw into the jumpboard 202. When tightened, the adjustment features 214 & 216 hold the ballet bar attachment 212 in place relative to the jumpboard 202.

In some embodiments, the adjustment features 214 & 216 can be spring loaded. When adjustment features 214 & 216 are spring loaded, they can be pulled on by a user (e.g., pulled away from the jumpboard) to release rods 222 & 224. When rods 222 & 224 are released, they can be adjusted up or down, which in turn adjusts the height of the ballet bar 226. When a user has adjusted the rods 222 & 224 to a desired position, the adjustment features 214 & 216 can be released. Upon release, in some embodiments, the adjustment features have a peg that fits into a receiving hole behind the rods 222 & 224. In some embodiments, each rod can include a series of holes designed to receive pegs that are coupled with each adjustment feature, and when a peg passes through a rod (e.g., when a user releases an adjustment feature), it holds the rod in place.

In other embodiments, adjustment features 214 & 216 can be any type of adjustable fastening component or quick release known in the art. In some embodiments, for example, adjusting features can be a peg that slots in and out of holes that are spaced along each leg 214 & 216.

Ballet bars of the inventive subject matter (such as ballet bars 226 and 116) have several key features. Ballet bars of the inventive subject matter preferably have rounded cross-sections. Ballet bars can have several different cross-sectional shapes including circular, oval, square, rectangle, or other irregular shapes. Different shapes can be useful to create a bar that is easier to grip, though it is contemplated that a rounded bar will be most commonly implemented. In preferred embodiments, ballet bars have circular cross-sections, while in other embodiments, the cross-section is merely rounded (e.g., oval, or rectangular with rounded edges). It is additionally contemplated that a ballet bar of the inventive subject matter can include several cross-sectional shapes across the length of a ballet bar. Ballet bars of the inventive subject matter are preferably straight, but it is contemplated that a curved ballet bar can be implemented.

Traditionally, ballet bars are made from wood, and it is contemplated that ballet bars of the inventive subject matter will also be fabricated from wood. In some embodiments, though, the ballet bar can be made from alternative materials or combinations of materials (e.g., metal, plastic, a composite material, or a combination of materials like a plastic with a rubber (or rubber-like) coating or wood with a rubber (or rubber-like) coating). For example, a ballet bar could be made from plastic and include one or more rubber portions to improve grip (e.g., if the user is sweating and their grip would otherwise slip, a rubber portion would serve to improve grip). Embodiments where a ballet bar has an outer covering or region where users commonly grab the bar can improve the longevity of a bar. For example, if a ballet bar has a removable rubber coating, when the removable coating wears out, it can be replaced.

In some embodiments, the ballet bar attachment can pivot to adjust its position relative to the jumpboard. Pivoting can help a user adjust the bar to the right height and position for that user. For example, the embodiment shown in FIGS. 1-5 includes two hinges 120 & 122 that facilitate pivoting about the axis that runs through hose hinges.

In addition, hinges 120 & 122 can be configured to be quickly adjustable. In the embodiment shown in FIGS. 1-5, hinges 120 & 122 include latching mechanisms 124 & 126 that hold the ballet bar 116 in a position relative to the jumpboard. The latching mechanisms 124 & 126 are themselves bars with slots cut into them. The slots in the latching mechanisms 124 & 126 fit over a peg that is sized and dimensioned to couple with a hole in each upper rod 138 & 140 (or, in some embodiments is formed as a part of each rod). When the latching mechanisms 124 & 126 are in use, they hold the ballet bar 116 (which is itself coupled with extension rods 128 & 130) in a fixed position (e.g., a fixed angle) relative to the jumpboard 102.

In some embodiments, one or more of the latching mechanisms can include additional features to prevent accidental unlatching. For example, in FIG. 13, the latching mechanism 1300 is constructed using three layers 1302, 1304, & 1306. The outer two layers 1302 & 1306 are stationary relative to the middle layer 1304. Middle layer 1304 is coupled with the outer layers 1302 & 1306 in part by a spring 1308. The outer layers 1302 & 1306 have slots 1310, 1312, & 1314 cut in them, similar to the latching mechanism shown in FIGS. 1-5 that hold the ballet bar stationary relative to the jumpboard. Because the middle layer of the latching mechanism is cut to fit over slots 1310, 1312, & 1314, the spring 1308 in the latching mechanism 1300 causes the middle layer 1304 to return to a position that prevents the latching mechanism from unlatching from a peg without first manually sliding the middle layer so that it no longer creates an obstruction.

Figure 13:
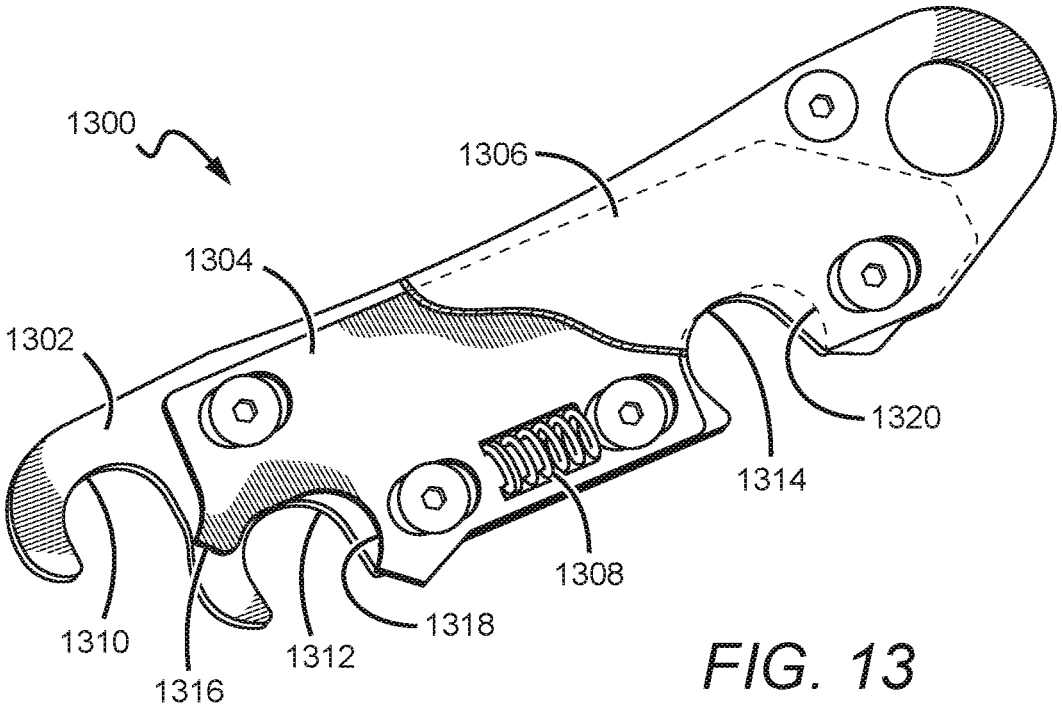
FIG. 13 shows an embodiment of a latching device for use with the inventive subject matter.

The obstruction created by the middle layer 1304 is caused by the way the features of the middle layer 1304 interact with slots 1310, 1312, & 1314 when the spring pulls the middle layer into a resting position. For example, as shown in FIG. 13, detents 1316, 1318, & 1320 (where reference numeral 1320 indicates the middle layer portion depicted with broken lines as it is beneath the top layer 1306) are implemented to prevent the latching mechanism from pulling away from a peg that is sized and dimensioned to fit into the slots 1310, 1312, & 1314 without first sliding the middle layer 1304 so that the detents 1316, 1318, & 1320 do not prevent unlatching. Thus, the middle layer 1304 naturally rests in a position that causes latching, and requires manual manipulation to slide it to an unlatching position.

In some embodiments, the ability of the ballet bar attachment 104 to pivot and latch into place enables a person to use the ballet bar 116 as a foot bar. When a ballet bar attachment 104 is coupled with a Pilates reformer, the ballet bar 116 can be pivoted so that it is positioned in front of the usable surface of the jumpboard 102 (e.g., the surface of the jumpboard 102 having various regions defined on its surface). The latching mechanisms 112 & 114 can hold the ballet bar 116 in that position so a person using the Pilates reformer can use the ballet bar 116 with their feet.

In embodiments where the ballet bar can be used as a foot bar, it is contemplated that the ballet bar (and all associated couplings between the ballet bar, the jumpboard, and the Pilates reformer) must be sufficiently strong to support the full weight of an adult (e.g., up to 300 pounds, static). In addition, devices of the inventive subject matter must be strong enough to withstand forces associated with different exercises such as lunges (which can involve high forces for brief periods of time) and planking. With devices of the inventive subject matter, people can use the Pilates reformer in its original format without having to remove the device (e.g. a jumpboard or a jumpboard with attached ballet bar) from the reformer to use/access the standard foot bar (which is timely process)

FIGS. 1-4 show an embodiment of the ballet bar attachment 104 that includes a bar 132 that spans the distance between the upper rods 138 & 140. Bar 132 can be used as an attachment point for a variety of different accessories. For example, resistance bands can be tied to the bar to facilitate exercises (e.g., resistance band training for the upper body, lower back, legs, etc.).

As shown in FIG. 3, on either side of the wide center portion of bar 132 are attachment points 134 & 136 (e.g., points where the cross-sectional area of the bar is much lower than in the center). Attachment points 134 & 136 are useful for attaching accessories using, for example, clips. Most clips (e.g., carabiners, spring-loaded pin clips like those used for dog leashes, etc.) require a small cross sectional area to attach to, so it is advantageous for bar 132 to include the smaller attachment points 134 & 136 so that a person can attach a wide array of accessories without needing to purchase any additional equipment.

In addition to attachment points 134 & 136, it is contemplated other attachment points 142 & 144 can be coupled with the extension rods 128 & 130. Seen best in FIG. 4, attachment points 142 & 144 are coupled with the extension rods 128 & 130 such that when the ballet bar 116 is in position to act as a footbar, attachment points 142 & 144 are facing away from the jumpboard to facilitate attachment of fitness accessories (e.g., springs, resistance bands, etc.). It is contemplated that additional attachment points can be coupled with the extension rods or with other components of the inventive subject matter.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

Thus, several systems and devices have been disclosed. It should be apparent to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. The terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. An accessory for use with an exercise device, the accessory comprising:

a jumpboard;

a ballet bar coupled with a first arm and a second arm, wherein the first arm and the second arm are slidably coupled to a planar surface of the jumpboard via a longitudinal slot in each of the first and second arms;

the jumpboard comprising a coupling feature integrally formed with the jumpboard to facilitate non-movable coupling of the accessory with the exercise device;

the coupling feature comprising a tab configured to fit into a slot on the exercise device, wherein the tab extends from a bottom portion of the jumpboard to hold the jumpboard in a vertical orientation upon coupling with the exercise device.

2. The accessory of claim 1, wherein the jumpboard comprises a surface, and the surface is divided into a first region and a second region, wherein the first region comprises a first characteristic, and the second region comprises a second characteristic.

3. The accessory of claim 2, wherein the first characteristic comprises a material.

4. The accessory of claim 2, wherein the first characteristic comprises a visually identifiable characteristic.

5. The accessory of claim 4, wherein the visually identifiable characteristic comprises at least one of a pattern, a color, and a non-repeating visual feature.

6. The accessory of claim 2, wherein the first characteristic comprises a tactilely identifiable characteristic.

7. The accessory of claim 1, wherein a position of the ballet bar relative to the jumpboard is adjustable.

8. The accessory of claim 1, further comprising a handle affixed to the jumpboard.

9. The accessory of claim 1, further comprising at least one expansion feature to facilitate use of the accessory with an expansion product.

10. The accessory of claim 1, further comprising a bracket, wherein coupling the bracket to the exercise device forms the slot on the exercise device into which the tab is configured to fit.

11. The accessory of claim 9, wherein the expansion product comprises at least one of a resistance band and a spring.

12. An accessory for use with an exercise device, the accessory comprising:

a jumpboard;

a ballet bar coupled with a first arm and a second arm, wherein the first arm and the second arm are rotatably coupled to a top portion of the jumpboard;

the jumpboard comprising a coupling feature affixed to the jumpboard wherein the coupling feature facilitates non-movable coupling of the accessory with the exercise device; and the coupling feature comprising at least a first frame and a second frame that are both configured to fit into a slot on the exercise device, wherein the first frame and the second frame extend from a bottom portion of the jumpboard to hold the jumpboard in a vertical orientation upon coupling with the exercise device.

13. The accessory of claim 12, wherein the jumpboard comprises a surface, and the surface is divided into a first region and a second region, wherein the first region comprises a first characteristic, and the second region comprises a second characteristic.

14. The accessory of claim 13, wherein the first characteristic comprises at least one of a material and a visually identifiable characteristic.

15. The accessory of claim 14, wherein when the first characteristic comprises the visually identifiable characteristic, then the visually identifiable characteristic comprises at least one of a pattern, a color, and a non-repeating visual feature.

16. The accessory of claim 14, wherein the first characteristic comprises a tactilely identifiable characteristic.

17. The accessory of claim 12, wherein a position of the ballet bar relative to the jumpboard is adjustable.

18. The accessory of claim 12, further comprising a handle affixed to the jumpboard.

19. The accessory of claim 12, further comprising at least one expansion feature to facilitate use of the accessory with an expansion product.

20. The accessory of claim 12, further comprising a bracket, wherein coupling the bracket to the exercise device forms the slot on the exercise device into which the first frame and the second frame are configured to fit.

* * * * *